United States Patent [19]

Bilbao

[11] Patent Number: 4,890,525

[45] Date of Patent: Jan. 2, 1990

[54] SLICING AND STORAGE BOX

[76] Inventor: Francisco Bilbao, 9245 SW 43 St., Miami, Fla. 33165

[21] Appl. No.: 299,196

[22] Filed: Jan. 23, 1989

Related U.S. Application Data

[63] Continuation-in-part of Ser. No. 142,428, Jan. 11, 1988, abandoned.

[51] Int. Cl.[4] ..... B26D 3/16

[52] U.S. Cl. ..... 83/762; 83/761; 30/124

[58] Field of Search ..... 83/761, 762, 763, 764, 83/648, 167; 30/124, 289, 290, 310

[56] References Cited

U.S. PATENT DOCUMENTS

| | | | |
|---|---|---|---|
| 1,072,450 | 9/1913 | Hamblin | 83/762 |
| 1,371,949 | 3/1921 | Brown . | |
| 1,554,638 | 9/1925 | McLeod | 83/762 |
| 1,605,770 | 11/1926 | Potter | 82/762 |
| 1,867,993 | 7/1932 | Tuttle | 83/762 |

*Primary Examiner*—Donald R. Schran

*Attorney, Agent, or Firm*—Jesus Sancheuma

[57] ABSTRACT

A device for storing and slicing foodstuff in the shape of an elongated bar has an elongated housing and a carrier assembly having an elongated and flat base member being slidably receivable within the housing. A cutting utensil housing is mounted on the top wall of the housing and defining an elongated cavity with an aperture. The carrier assembly includes a cover member perpendicularly mounted at one of said ends for cooperatively closing its opening and the apertures of the cutting utensils cavity when the carrier assembly is completely housed within the housing. A plurality of upwardly mounted post members along the lateral edges of the flat base member, by opposing pairs, so that a separation is maintained between adjoining post members to allow a cutting utensil through for cutting the slices form the bar. When the device is being opened, the cutting device is pulled out simultaneously by virtue of an inwardly extending hook member mounted on the cover of the carrier assembly. A sponge is removably mounted on the carrier to allow the user to clean the blade of his cutting utensil.

7 Claims, 2 Drawing Sheets

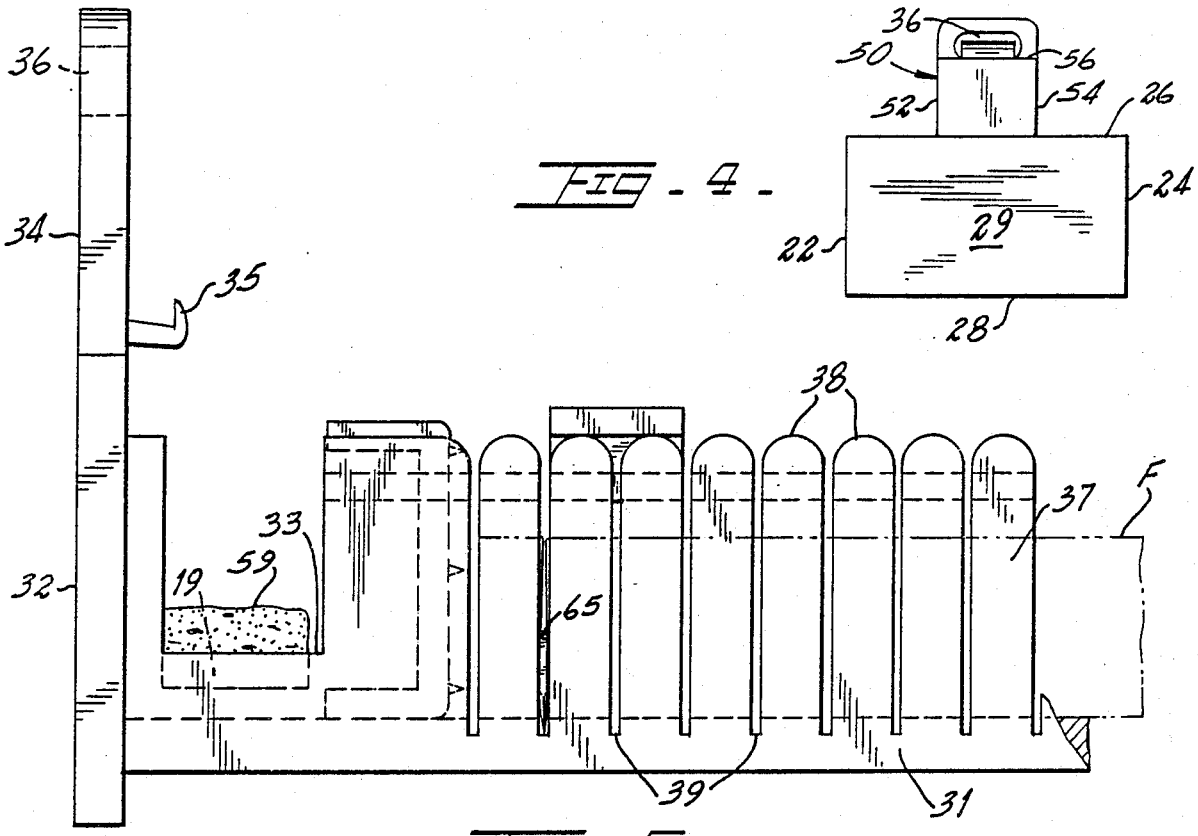
FIG. 4.
FIG. 5.
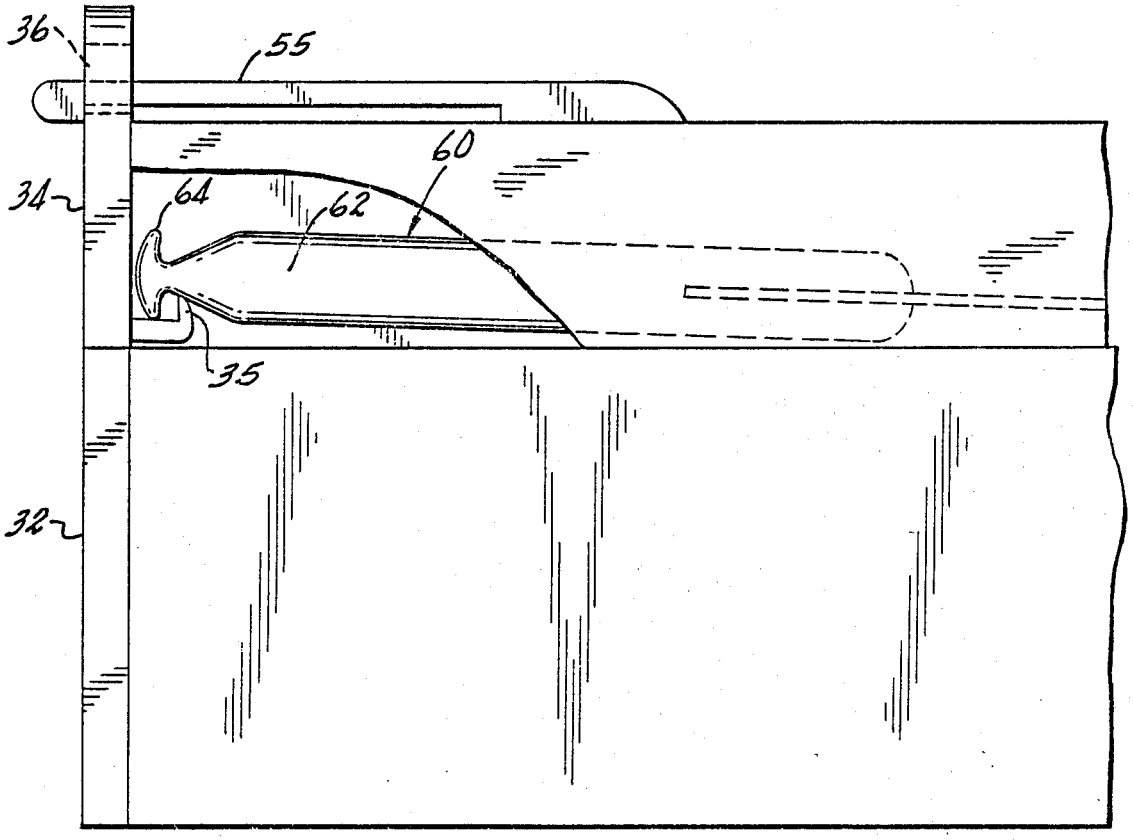
FIG. 6.

SLICING AND STORAGE BOX

OTHER RELATED APPLICATIONS

The present invention is a continuation-in-part of U.S. applications Ser. No. 07/142,428 filed n January 11, 1988, now abandoned.

BACKGROUND OF THE INVENTION

.1. Field of the Invention.

The present invention relates to storage and slicing devices, and more particularly, to those devices that are best suited for food items that come in bars, such as cheese, guava paste and others. Description of the Related Art.

Applicant believes that the closest reference corresponds to U.S. Pat. No. 1,371,849 issued to Brown. However, it differs from the present invention because the food and the cutting utensil are both exposed to the elements and insects. Furthermore, it lacks the elements and characteristics described and claimed below.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a storage and slicing device that will keep the foodstuff and cutting utensil contained therein away from insects.

It is another object of this present invention to provide such a device that will help a user in achieving uniformity on the slices cut.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 is a representation of the rear view of the prsent invention.

FIG. 5 is a partial side view of the carrier assembly showing the cutting utensil cutting through a bar of guava paste or cheese.

FIG. 6 represents a partial side view of the device completely housing the carrier assembly and a broken section showing the manner in which the cutting utensil engages to the hook inwardly mounted in the inner wall of the cover member.

DETAILED DESCRIPTION OF THE PREFERRED EMBODIMENT

Figures 1, 2, 3:
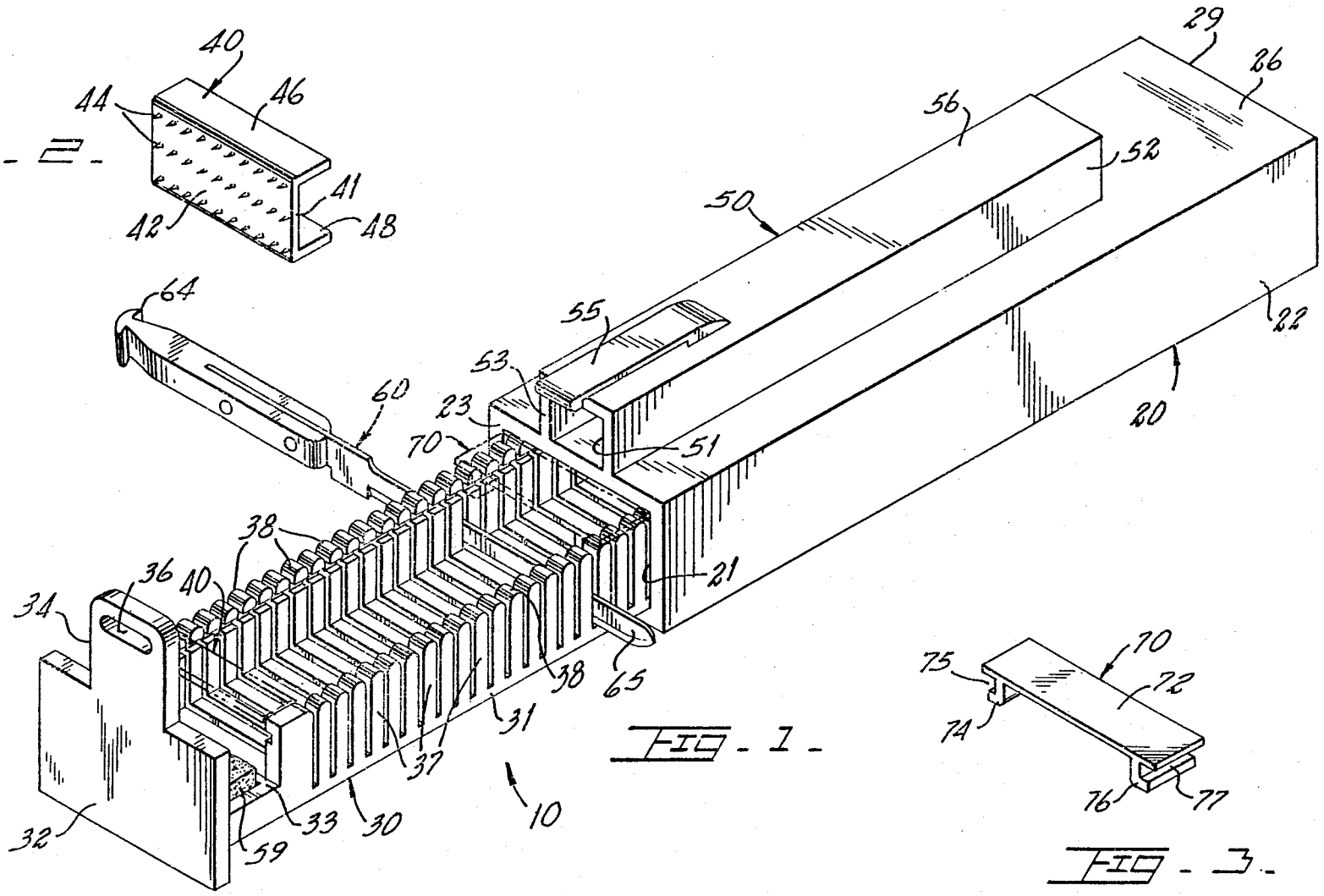
FIG. 1 represents a view in perspective of the storage and slicing device subject of the present application.
FIG. 2 shows a view in perspective of the slice holder showing the surface provided with gripping teeth.
FIG. 3 illustrates a view in perspective of the guide used to help the user in aligning the cutting utensil.

Referring now to FIG. 1, where the present invention is generally referred to with numeral 10, it can be observed that it basically includes housing assembly 20 that cooperatively receives carrier assembly 30. As shown in FIGS. 1 and 4, housing assembly 20 includes side walls 22 and 24, top wall 26, rear wall 29 and bottom wall 28. Cutting utensil housing 50 is mounted on top wall 26 and ends with opening 51 in alignment with compartment opening 21 of housing assembly 20. Rims 23 and 53 are preferably located on the same plane. Cutting utensil housing 50 includes, as seen in FIGS. 1 and 4, lateral walls 52 and 54, rear wall 59 and upper upper wall 56 thereby defining a compartment of sufficiently large dimensions to cooperatively house cutting utensil 60.

Carrier assembly 30 includes an elongated base member having dimensions somewhat smaller than bottom wall 28 so that it can be slidably housed within housing assembly 20. Carrier assembly 30 includes cover member 32 that is perpendicularly mounted to one end of base member 31. Cover member 32 has a hook member 35 rigidly and inwardly mounted to the inner surface of cover member 32. Cover member 32 has preferably an upwardly extending tongue 34 that cooperatively closes aperture 51 when carrier assembly 30 is completely housed within housing assembly 20. Tongue member 34 extends upwardly beyond upper wall 56 and it includes an opening 36 that cooperates with latching member 55 that is mounted on upper wall 56, as shown in FIG. 1.

Sponge member 59 is positioned substantially adjacent to cover member 32, in recess 19 defined by frame 33 formed preferably above base member 31. Sponge member 59 is held in place by recess 19 so that cutting utensil 60 can be cleaned by slidably pressing it against sponge member 59. If desired, sponge member 59 can be wet in order to facilitate the cleaning of blade 65. Several guiding posts 37 are rigidly and upwardly mounted to the periphery of base member 30 having round upper ends 38, as can be best seen in FIG. 5. Blade 65 of cutting utensil 60 is seen cutting through foodstuff F and going all the way down to channel 39 on base member 31 in order to insure that the slice was completely separated from the bar of of foodstuff F.

Slice holder 40, as shown in FIG. 2, has a flat member 41 with outer surface 42 having a plurality of gripping teeth 44 that come in contact with the slice being cut, and after being helped with the cutting utensil, the slice is handled with holder 40 avoiding direct contact with the user's fingers. Holder 40 includes perpendicularly mounted tabs 46 and 48 having sufficient area to allow the user to grab it.

Guiding member 70, as shown in FIGS. 1 and 3, includes an elongated flat member 72 with L-shape members 74 and 76 rigidly mounted to its underside thereby providing guiding passages 75 and 77 for receiving round terminations 38 from the inner side. A user slides guiding member 70 over rounded terminations 38 to a position where he or she wants to cut the slice. Guiding member 70 insures that blade 65 will not cross to a separation between post members 37 that does not correspond.

Cutting utensil 60 includes a handle member 62 that ends with a hook termination 64 that resembles a marine anchor. Hook termination 64 cooperatively engages with inwardly extending hook member 35 so that when carrier assembly 30 is slidably pulled outwardly, cutting utensil 60 is pulled out also.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A device for storing and slicing foodstuff in the shape of an elongated bar, comprising:

A. elongated housing means including two side walls parallel to each other and in a spaced apart relationship, a bottom wall and a top wall parallel to each other in a spaced apart relationship and perpendicularly mounted with respect to said side walls and a rear wall perpendicularly mounted at the end of said side, bottom and top walls thereby defining a compartment with an opening;

B. carrier means having an elongated and flat base member with an upperside and having two ends and two lateral edges and being slidably receivable within said housing means, and said carrier means including a cover member perpendicularly mounted at one end of said ends for cooperatively closing said opening of said housing means when said carrier means is completely housed within said housing means and said base member having a plurality of upwardly mounted post members along said laterial edges, by opposing pairs, so that a separation is maintained between adjoining post members and said channels being positioned between adjoining post members so that said cutting utensil is allowed to cut completely through said bar thereby separating the resulting slice from the rest of the bar;

C. means for cutting said bar including a handle and a blade; and

D. means for guiding said cutting utensil and including an elongated flat member, having an underside and an upperside, and said flat member is slidably positioned over said post members and said elongated flat member includes two ends and each of said ends comes in contact with the upper terminations of said post members.

2. The device set forth in claim 1 wherein said post members include a round headed termination and said means for guiding said cutting utensils include two L-shape members mounted to the underside of said means for guiding said cutting utensil and said L-shape members form a guiding passage that cooperatively receives said round headed terminations of said post members.

3. A device for storing and slicing foodstuff in the shape of an elongated bar, comprising:

A. elongated housing means including two side walls parallel to each other and in a spaced apart relationship, a bottom wall and a top wall parallel to each other in a spaced apart relationship perpendicularly mounted with respect to said side walls and a rear wall and perpendicularly mounted at the end of said side, bottom and top walls thereby defining a compartment with an opening;

B. cutting utensil housing means including two lateral walls parallel to each other and in a spaced apart relationship mounted on said top wall, an upper wall positioned perpendicularly to said lateral walls and a rear wall perpendicularly mounted at the end of said lateral walls and said walls thereby defining an elongated cavity with an aperture;

C. carrier means having an elongated and flat base member with two ends and two lateral edges and being slidably receivable within said housing means and said carrier means including a cover member perpendicularly mounted at one of said ends for cooperatively closing said opening of said housing means compartment and the aperture of said cutting utensils cavity when said carrier means is completely housed within said housing means and said housing means having a plurality of upwardly mounted post members along said lateral edges, by opposing pairs, so that a separation is maintained between adjoining post members; and D. means for cutting said bar including a handle and a blade.

4. The device set forth in claim 3 wherein said base member includes a plurality of straight channels on the upperside of said base member and said channels being positioned between opposing separations so that said cutting utensil is allowed to cut completely through said bar thereby separating the resulting slice from the rest of the bar.

5. The device set forth in claim 4 wherein said base member includes a plurality of straight channels on the upperside of said base member and said channels being positioned between opposing separations so that said cutting utensil is allowed to cut completely through said bar thereby separating the resulting slice from the rest of the bar.

6. The device set forth in claim 5, further comprising:

E. means for guiding said cutting utensil and including an elongated flat member, having an underside and an upperside, and said flat member is slidably positioned over said post members and said elongated flat member includes two ends and each of said ends comes in contact with the upper terminations of said post members.

7. The device set forth in claim 6 wherein said post members include a round headed termination and said means for guiding said cutting utensils include two L-shape members mounted to the underside of said means for guiding said cutting utensil and said L-shape members form a guiding passage that cooperatively receives said round headed terminations of said post members.

* * * * *